United States Patent [19]

Field et al.

[11] Patent Number: 4,515,884

[45] Date of Patent: May 7, 1985

[54] FUSING SYSTEM WITH UNBLENDED SILICONE OIL

[75] Inventors: John R. Field, Red Creek; Haribhajan S. Kocher, Penfield; Arthur C. Martellock, Pittsford, all of N.Y.

[73] Assignee: Xerox Corporation, Stamford, Conn.

[21] Appl. No.: 420,996

[22] Filed: Sep. 21, 1982 (Under 37 CFR 1.47)

[51] Int. Cl.[3] ..... G03G 13/20

[52] U.S. Cl. ..... 430/99; 106/2; 118/60; 118/70

[58] Field of Search ..... 430/99; 106/2; 118/60, 118/70

[56] References Cited

U.S. PATENT DOCUMENTS

| | | | |
|---|---|---|---|
| 4,064,313 | 12/1977 | Takiguchi et al. | 428/447 |
| 4,078,286 | 3/1978 | Takiguchi et al. | 29/132 |
| 4,085,702 | 4/1978 | Consaul et al. | 118/60 |
| 4,287,280 | 9/1981 | Swift | 430/99 |

*Primary Examiner*—Evan K. Lawrence

[57] ABSTRACT

Toner images are fused to a substrate, such as paper, with a heated fusing member having a silicone elastomer fusing surface by coating the elastomer fusing surface with a toner release agent which includes an unblended polydimethyl siloxane having a kinematic viscosity of from about 7,000 centistokes to about 20,000 centistokes. In a preferred embodiment the polydimethyl siloxane oil has a kinematic viscosity of from about 10,000 to about 16,000 centistokes and the fuser member is a fuser roll having a thin layer of a cross-linked product of a mixture of $\alpha\omega$-dihydroxypolydimethyl siloxane, finely divided tabular alumina and finely divided iron oxide.

19 Claims, 2 Drawing Figures

RELEASE PERFORMANCE OF VARIOUS SILICONE OILS

FUSING SYSTEM WITH UNBLENDED SILICONE OIL

BACKGROUND OF THE INVENTION

The present invention relates generally to xerographic copying methods, and more particularly to a contact fusing system for fixing toner material to a support substrate. In particular, the present invention relates to a method of fusing employing a novel toner release agent.

In the process of xerography, a light image of an original to be copied is typically recorded in the form of an electrostatic latent image upon a photosensitive member with subsequent rendering of the latent image visible by the application of electroscopic marking particles commonly referred to in the art as toner. The residual toner image can be either fixed directly upon the photosensitive member or transferred from the member to another support, such as a sheet of plain paper with subsequent affixing or the image thereto.

In order to fix or fuse the toner material onto a support member permanently by heat, it is necessary to elevate the temperature of the toner material to a point at which constituents of the toner material coalese and become tacky. This action causes the toner to flow to some extent into the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the fuser roll thereby to affect heating of the toner images within the nip. Typical of such fusing devices are two roll systems wherein the fusing roll is coated with an abhesive material, such as a silicone rubber or other low surface energy elastomer or, for example, tetrafluoroethylene resin sold by E. I. DuPont De Nemours under the trademark Teflon. The silicone rubbers which can be used as the surface of the fuser member can be classified into three groups according to the vulcanization method and temperature, i.e., room temperature vulcanization silicone rubber hereinafter referred to as RTV silicone rubber, low temperature vulcanization silicone rubber, referred to as LTV rubber, and high temperature vulcanization type silicone rubber, referred to as HTV rubber. All these silicone rubbers or elastomers are well known in the art and are commercially available.

In these fusing systems, however, since the toner image is tackified by heat it frequently happens that a part of the image carried on the supporting substrate will be retained by the heated fuser roller and not penetrate into the substrate surface. This tackified material will stick to the surface of the fusing roller and come in contact with the subsequent sheet of supporting substrate bearing a toner image to be fused. A tackified image which has been partially removed from the first sheet, may transfer to the second sheet in non-image portions of the second sheet. In addition, a portion of the tackified image of the second sheet may also adhere to the heated fuser roller. In this way and with the fusing of subsequent sheets of substrates bearing the toner images, the fuser roller may be thoroughly contaminated. In addition, since the fuser roller continues to rotate when there is no substrate bearing a toner image to be fused therebetween toner may be transferred from the fuser roll to the pressure roll. This condition is referred to in the copying art as "offset". Attempts have been made to control the heat transfer to the toner and thereby control the offset. However, even with the abhesive surfaces provided by the silicone elastomers, this has not been entirely successful.

It has also been proposed to provide toner release agents such as silicone oil, in particular, polydimethyl silicone oil, which is applied on the fuser roll to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from offsetting to the fuser roll surface.

In the two roll fusing systems wherein a silicone elastomer is used as the fuser surface, the silicone release oil typically has a viscosity of the order of 100 centistokes. This low viscosity enables the oil to be readily applied to the roll through a wicking process in a relatively easy manner to form the parting layer between the fuser roll and the image bearing surface. However, these low viscosity oils suffer from the difficulty in that being relatively low in viscosity, they are also relatively low in molecular weight, and thereby contribute to a swelling of the fuser roll by the migration or absorption of the silicone oil into the silicone rubber. Under certain conditions some small swelling may be acceptable, if it is uniform. However, the oil applied from the wick will be continuously removed by the paper but not removed outside the paper path. Thus, there will be a differential swelling between the areas inside and outside of the paper path. In addition, the passage of paper through the nip will cause a higher compression on the roll inside the paper path. Thus, there is a step created by swell on the roll at the 11 inch wide paper path. If the step height reaches about 3.0 mils and a 14 inch wide paper is now used, the toner along the 11 inch wide paper path edge will not be fused properly because of the step. This is referred to in the art as soft failure. The greater the rubber swells, the sooner the step will reach the critical failure dimension. In this way, rubber swell determines the soft failure life of a fuser roll.

Another type of failure occurs when rubber is delaminated from the core. This is known as hard failure. The exact mechanism is not clear but is believed to be due to the silicone oil diffusing through the rubber matrix to reach the core, where the silicone oil swelling can weaken the rubber at the locus of highest stress concentration and thereby cause delamination.

With the difficulties encountered in swelling of the fuser roll through the use of the low molecular weight and low viscosity release materials, it was first suggested to use the higher viscosity toner release agents to avoid this problem. Thus silicone oils having viscosities of up to say 60,000 centistokes were attempted. However significant difficulties were encountered in trying to handle this very high viscosity material. Particularly difficulties were encountered in trying to wick the material or deliver it from a supply source to the surface of the fuser roll. In addition the wicks have a tendency to clog with the high viscosity material and may even physically break down or shred.

Furthermore, since the wick is generally continuously engaged to the fuser member, a puddle of the silicone oil is created on the fuser roll. This puddle becomes excessively large with high viscosity silicone oils particularly during periods of idleness. Therefore after a period of idleness, the first copy fused contacts a fuser roll with a lot of oil on its surface which offsets to the copy paper which is objectionable. Furthermore, with the operation of the machine during a sequence of many short runs, the wicks are observed to dry out frequently since at each period of idleness they consume a lot of oil which is immediately taken up by the first few copies in the copy run. Thus with the concentration of oil in the wick required to pump the amount of oil necessary in the high viscosity type oils a much larger puddle was required. Furthermore, with the higher viscosity oils, the oils do not flow through the wick very rapidly and thus difficulties are encountered in the transportation of the oil from the supply to the operational surface. This is true because the high viscosity oil is much more difficult to move on a continuous basis. These high viscosity oils are manufactured as blends of other oils. A silicone oil having a viscosity of the order of 60,000 centistokes is made by blending separately made oils having viscosities of the order of 100,000 and 1,000 centistokes.

In addition to the above difficulties, the operational latitude of a fusing system employing the 60,000 centistokes oil is unduly restricted. By operational latitude it is intended to mean the difference in temperature between the minimum temperature required to fix the toner to the paper, the minimum fix temperature, and the temperature at which the hot toner will offset to the fuser roll, the hot offset temperature. Typically with the high viscosity 60,000 centistokes blended silicone oils, this operational latitude with a single paper is of the order of 60°–70° F. This has been determined to be too narrow for modern day reproducing flexibility which requires the capability to use many different types and weights of paper, different toner materials and amounts thereof, as well as respond to use in a wide variety of speeds and other operational conditions. It is also true that greater latitude is required to provide high quality copies particularly where toner pile height is increased to provide improved copy quality.

PRIOR ART

U.S. Pat. No. 4,085,702 (Consaul et al) is directed to a toner offset prevention device wherein the offset preventing material is sprayed onto the surface of the fusing member. In particular, a high viscosity oil, i.e., having a viscosity greater than 10,000 and up to 100,000 centistokes may be sprayed directly onto the fuser roll. This avoids the difficulties associated with wicking the high viscosity oils. It is noted however that all the silicone oils mentioned in this disclosure are used in the form of an emulsion having a water like viscosity.

SUMMARY OF THE INVENTION

Accordingly, it is an object of the present invention to provide an improved method for fusing a toner image on an image support substrate.

It is another object of the present invention to provide a novel release agent, enabling the application of this agent to a fusing surface made of a silicone elastomer by wicking.

It is a further object of the present invention to provide a fusing method using a silicone release agent wherein the release agent exhibits swell properties normally obtained with relatively high viscosity materials and at the same time exhibiting handling properties normally obtained with relatively low viscosity materials.

It is a further object of the present invention to provide a fusing method having improved fusing latitude between minimum fix temperature and hot offset temperature.

The above objects and others are accomplished in accordance with the present invention wherein a method for fusing toner images to a supporting substrate is provided. In particular, the method comprises providing a fusing member having a silicone elastomeric fusing surface, heating the surface to an elevated temperature to fuse the toner to the substrate, and coating the silicone elastomer fusing surface with a toner release agent comprising an unblended polydimethyl siloxane oil having a kinematic viscosity of from about 7,000 centistokes to about 20,000 centistokes, and finally contacting the toner image on the substrate with a heated fusing member to thereby fuse the toner image to the toner substrate. In a specific aspect of the present invention, the polydimethyl siloxane oil release fluid has a kinematic viscosity of from about 10,000 centistokes to about 16,000 centistokes and the fusing member is a fuser roll having a thin layer of a cross-linked product of a mixture of hydroxypolydimethyl siloxane, finely divided tabular alumina, finely divided iron oxide and a suitable cross-linking agent and catalyst.

DETAILED DESCRIPTION OF THE INVENTION

Figure 1:
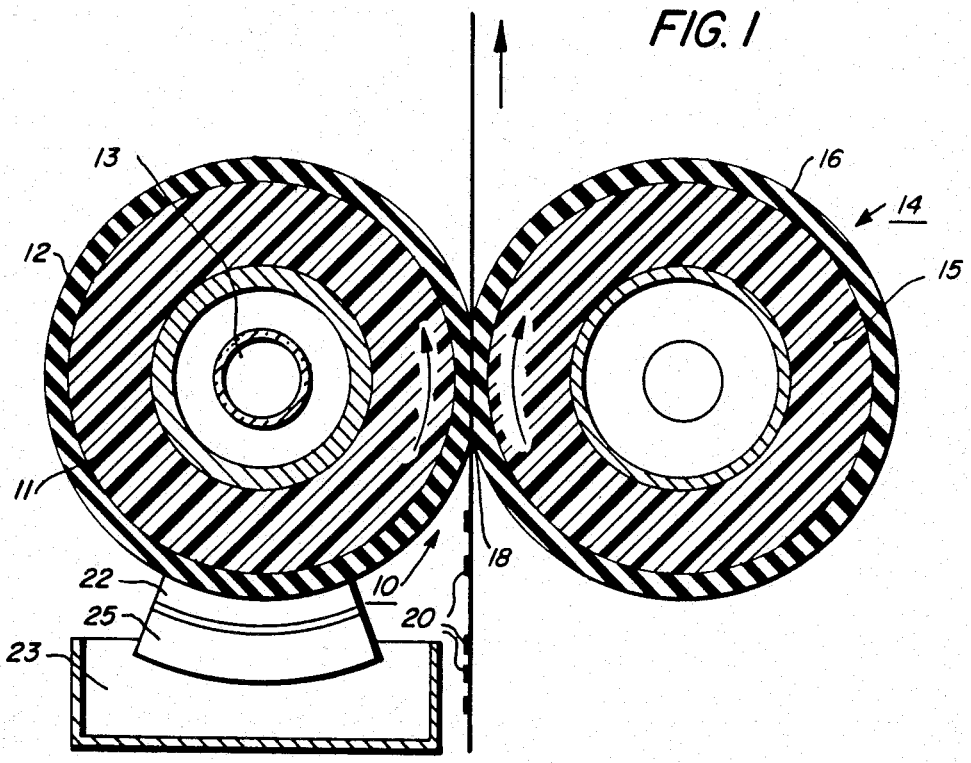
FIG. 1 is a cross-sectional view of a roll fuser system which may use the fusing technique of the present invention.

We have found that an unblended polydimethyl siloxane having a kinematic viscosity of from about 7,000 centistokes to about 20,000 centistokes when used in a fusing system with a silicone elastomeric fuser member provides dramatically improved handling or wicking characteristics of the oil to the fuser system without degrading or excessively swelling the rubber. In particular, we are able to maintain the degree of swell of a silicone elastomer fuser roll to a very low tolerable level and at the same time we are able to physically handle a high viscosity silicone release agent. In addition a dramatically improved fusing latitude which is the temperature differential between lowest acceptable fix and the onset of hot offset of toner is achieved. We attribute this to the improved wicking capability with lower viscosity oils thereby providing more uniform application of oil at a higher rate with lower wick concentration. In particular, we have found that with an unblended silicone oil which has a comparatively narrow molecular weight distribution we are able to maximize the silicone oil handling and operational latitude while minimizing the difficulties caused by the silicone oil in swelling the silicone elastomer.

As briefly outlined above, the prior art high viscosity silicone oils, i.e., 60,000 centistokes, are made of a blend of about 1,000 centistokes oil and 100,000 centistokes oil, which from a fluid handling or wicking point of view are very difficult to handle. However, we have found that if we use an unblended silicone oil having about the same number average molecular weight as the high viscosity (60,000 centistokes) blend but a lower viscosity, about 7,000 to about 20,000 centistokes, we are able to both physically handle the oil and maintain the swell of a silicone elastomer fuser member within acceptable limits. As is well known the Number Average Molecular Weight $\overline{M}_n$ may be determined by the formula:

$$\overline{M}_n = \frac{\sum_{i=1}^{\infty} M_i N_i}{\sum_{i=1}^{\infty} N_i}$$

and the Weight Average Molecular Weight $\overline{M}_w$ by the formula:

$$\overline{M}_w = \frac{\sum_{i=1}^{\infty} N_i M_i^2}{\sum_{i=1}^{\infty} N_i M_i} = \sum_{i=1}^{\infty} W_i M_i$$

where $M_i$=molecular weight of the $i^{th}$ species $N_i$=number of moles of the $i^{th}$ species $W_i$=weight of the $i^{th}$ species Since the number average molecular weight of the silicone oil determines the amount that the silicone rubber fuser member will swell if that molecular weight is maintained we can essentially maintain the swelling of the silicone rubber fuser member at the level of a high viscosity, 60,000 centistokes material. Further, the weight average molecular weight of the silicone release material which controls the kinematic viscosity of the fluid can be reduced while maintaining the number average molecular weight at its original level. Ideally if there is only one species of molecule the number average molecular weight and the weight average molecular weight will be the same and the ratio of weight average molecular weight to number average molecular weight will be one. However, in reality for silicone systems this does not take place and the best ratio that can be achieved with pure monomers and the best economical polymerization techniques is about 2. This is because with the spread of species the individual heavier molecules become more important in calculating the weight average molecular weight and therefore the weight average molecular weight will be higher than the number average molecular weight. With the prior art materials such as the blended 60,000 cs silicone oils a rather broad ratio is achieved of the order of about 3.5. We have found that we can reduce this ratio by reducing the weight average molecular weight. We can at the same time maintain the relatively low swelling characteristics of the higher viscosity material while reducing the viscosity of the material and thereby its ease of handling. This is so because as noted above, the viscosity is a function of the weight average molecular weight.

A simple example illustrates the principle. The 60,000 centistokes blended silicone oil of the prior art has a number average molecular weight of about 33 kilograms per mole and a weight average molecular weight of about 99 kilograms per mole which gives a ratio of about 3. If we reduce this ratio to say about 2, the weight average molecular weight is about 66 kilograms per mole. However, the viscosity of this unblended material will only be about 13,000 centistokes. This is because the weight average molecular weight, of which the viscosity is a function, has been substantially reduced. This is accomplished by precise control over the otherwise conventional manufacturing process. The purity of the monomers is closely controlled. In addition the amount of polymerization chain blocker placed in the polymerization vessel is closely controlled. Once it is known what ratio of weight average molecular weight to number average molecular weight is desired, the artisan may readily select the appropriate monomers and blocker is conventional manner.

Returning to the example illustrated, since the amount of low molecular weight and high molecular weight material have been reduced in the unblended material, the ratio and the weight average molecular weight have been reduced. Consequently while the swelling properties have been maintained substantially constant, the 13,000 centistokes unblended oil will roughly flow at a rate four times faster through a wick than the 60,000 centistokes material. In summary the present invention takes full use of the fact that an unblended silicone oil can be made which when compared to a reference blend silicone oil has the same number average molecular weight but a substantially reduced weight average molecular weight. In this way an unblended silicone oil having a number average molecular weight providing a suitable swelling level when used with a silicone elastomer can be made which has a reduced weight average molecular weight when compared to a blended material having the same number average molecular weight.

With lower number average molecular weight, the size of the individual silicone oil molecules is smaller and since there is a natural affinity by the silicone oil for the silicone elastomer, the fluid molecules more readily penetrate or are absorbed by the silicone elastomer. Thus by maintaining the number average molecular weight constant we have obtained acceptable swell properties of the silicone elastomer by the silicone oil and by reducing the weight average molecular weight of the silicone oil we have obtained acceptable handling properties in the oil. It will be understood that by acceptable swell according to the present invention, we mean a swell of less than about 4% and preferably less than about 3% by volume.

To further contrast the prior art blended silicone oils, the silicone oils used in the present invention are unblended by which we intend that they be manufactured in a single straight run process and not be a mixture of more than one oil manufactured in more than one straight run process. The silicone oils according to the present invention are unblended polydimethyl siloxanes having a kinematic viscosity of from about 7,000 to 20,000 centistokes. For best control over fusing latitude and swelling the unblended polydimethyl siloxanes of the present invention have a kinematic viscosity of from about 10,000 to about 16,000 centistokes with optimum control over latitude and swelling being achieved with a kinematic viscosity of about 13,000 centistokes. The molecular weight distribution curve for the oils according to the present invention would be a relatively narrow distribution. This is to be contrasted with the prior art blended oils which would show a much broader distribution.

The polydimethyl silicone oil of the present invention are represented by the structured formula:

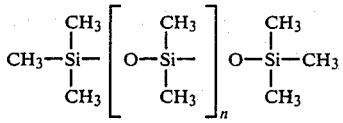

wherein n the number average degree of polymerization is of the order of from about 325 to 500.

Typically the polydimethyl silicone oils of the present invention are manufactured according to well known procedures and are available from several commercial manufacturers such as Dow Corning. Typical procedure would include heating a suitable mixture of siloxane tetramer, catalyst and endblocker containing, for example, trimethyl siloxy groups; equilibrating the product to yield the desired viscosity polydimethyl siloxane and some lower molecular weight compounds which are driven off by heating in a vacuum. It is important to remove the low molecular weight volatile materials because if they remain in the oil when the oil is used and subjected to the elevated fusing temperature, they may be volatilized and corrode or otherwise contaminate some of the more sensitive electrical and mechanical components of the machine in which it is operating.

As may be observed from the table below gel permeation chromotography data confirms that the materials used in the present invention are unblended materials. These data for weight average $\overline{A}_w$ and number average molecular weight $\overline{A}_n$ are proportional to the true molecular weight and differ from the absolute values of the true molecular weight by the same factor. Therefore the ratio of $\overline{A}_w$ to $\overline{A}_n$ is a reasonably accurate ratio within the limits of experimental error. As will be observed for the materials used in the present invention this ratio is less than 2.5 which confirms that the materials are unblended since it is just slightly above two, the best ratio achievable as previously mentioned. This is to be distinguished from the blended materials of the prior art which have a ratio of the order of 3.5 and higher.

GEL PERMATION DATA

| Sample Viscosity Centistokes | $\overline{A}_w$ | $\overline{A}_n$ | $\overline{A}_w/\overline{A}_n$ |
|---|---|---|---|
| 7,000 | 1498 | 774 | 1.9 |
| 9,700 | 1727 | 833 | 2.1 |
| 13,000 | 1852 | 976 | 1.9 |
| 17,000 | 2070 | 941 | 2.2 |
| 20,000 | 2008 | 96 | 2.1 |

It is very difficult to determine with accuracy the molecular weight or value of n for the materials used in the present invention. However, by defining the viscosity and the ratio of weight average molecular weight to number average molecular weight the molecular weight has been defined.

FIG. 1 shows a fuser roll 10 useful for use in the present invention. Although the fuser member shown in FIG. 1 is in the form of a roll, it is to be understood that the present invention is applicable to fuser members of other shapes, such as plates or belts. In FIG. 1, the fuser roll 10 is composed of a core 11 having coated thereon a thin layer 12 of a silicone rubber. The core 11 may be made of various metals such as iron, aluminum, nickel, stainless steel, etc., and various synthetic resins. We prefer to use aluminum as the material for the core 11, although this is not critical. The core 11 is hollow and a heating element 13 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. All heating means are well known in the art for providing sufficient heat to fuse the toner to the support. The composition of layer 12 will be described in detail below.

The fuser roll 10 is shown in a pressure contact arrangement with a backup or pressure roll 14. The pressure roll 14 comprises a metal core 15 with a layer 16 of a heat-resistant material. In this assembly, both the fuser roll 10 and the pressure roll 13 are mounted on shafts (not shown) which are biased so that the fuser roll 10 and pressure roll 14 are pressed against each other under sufficient pressure to form a nip 18. It is in this nip that the fusing or fixing action takes place. It has been found that the quality of the copies produced by the fuser assembly is better when the nip is formed by a relatively hard and unyielding layer 16 with a relatively flexible layer 12. In this manner, the nip is formed by a slight deformation in the layer 12 due to the biasing of fuser roll 10 and the pressure roll 14. The layer 16 may be made of any of the well known materials such as polyfluoroethylenepropylene or a silicone rubber.

A sheet of a support material 19, such as a sheet of paper, bearing thereon toner image 20 passes between the fuser roll 10 and pressure roll 14. On fuser roll 10 is mounted an intermediate oil-feeding member such as cover wick 22 from which an offset preventing fluid or release agent is applied to the fuser roll 10. The wick may be made of any suitable material. Typical materials include Teflon, tetrafluorethylene fluorocarbon polymers and Nomex, a nylon fiber both of which are available from E. I. DuPont de Nemours and Co.. The intermediate oil feeding member 22 also performs the function of cleaning the fuser roll 10. The release agent in sump 23 is fed to the oil feeding member 22 through another intermediate oil feeding member 25 which may be made of Nomex or wool, for example, from a sump 23 by any suitable means.

The polydimethyl siloxane releases fluids of the present invention may be used with any suitable fuser member. Typically the fuser member is thermally conductive, has high thermomechanical strength, is flexible, and conformable so that it can form a nip with a relatively hard pressure roll. Typically it has a fusing surface made of any suitable silicone rubber such as the RTV, LTV and HTV silicone rubbers previously described.

A particularly preferred coating composition comprises a crosslinked αω-hydroxypolydimethyl siloxane. In a specific embodiment the coating composition comprises (a) 100 parts of an αω-dihydroxypolydimethyl siloxane having a number average molecular weight of between about 5,000 to 20,000;
(b) about 128 to 250 parts by weight of a finely divided tabular alumina;
(c) about 13 to 60 parts by weight of a finely divided iron oxide;
(d) about 6 to 9 parts by weight of a crosslinking agent; and
(e) about 0.25 to 1.8 parts by weight of a crosslinking catalyst.

The αω-dihydroxypolydimethyl siloxane, which is a disilanol, is believed to have the structural formula:

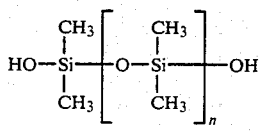

wherein n is an integer whose magnitude depends on the number average molecular weight of the disilanol. For the purpose of the present invention, we prefer to use a disilanol having a number average molecular weight between about 5,000 to 20,000. In commercially available materials, this number average molecular weight corresponds roughly to materials having an average viscosity ranging from about 500 centistokes (Cstk) to about 3,500 Cstk. With a disilanol having a number average molecular weight of less than about 5,000, which roughly corresponds to an average viscosity of about less than 500 Cstk, the material is of relatively short chains and therefore contains more active sites at the ends of the chains for crosslinking during the curing step. This yields a material which contains too high a crosslinking density, and which is relatively hard and brittle and not suited for the purposes of the present invention.

With a disilanol having a number average molecular weight in excess of about 20,000, which roughly corresponds to an average viscosity of about 3,500 Cstk, the cured composition does not have sufficient crosslinking density to attain maximum strength and fatigue resistance, and therefore does not have sufficiently long operational life.

The alumina is incorporated in the composition to improve the thermal conductivity of the resultant composition. An important aspect of the present invention resides in the use of tabular alumina. The other commonly available form of alumina, calcined alumina, is unsuitable per se. Tabular alumina is a sintered alumina that has been heated to a temperature slighty below 3700° F., the fusion point of aluminum oxide. Due to this high temperature treatment during its manufacturing process, it is believed that tabular alumina has a more coalesced surface than calcined alumina, which is generally prepared at a much lower temperature. It is further believed that the coalesced surface of tabular alumina results in less interaction between the tabular alumina and the disilanol polymer, which leads to other desireable results. The name "tabular" came from the fact that the material is composed predominantly of tablet-like crystals. This material is characterized by good thermal conductivity and chemical inertness. For the purposes of the present invention, the size of the tabular alumina used is important. The tabular alumina must be finely divided and be not larger than about 100 mesh in size. At the present time, the finest size tabular alumina commercially available is 325 mesh, corresponding to a maximum size of about 44 micrometers. This sized tabular alumina has been found to be very suitable for the purposes of the present invention.

The amount of tabular alumina employed is important. Sufficient amount of the tabular alumina should be employed to give the resultant composition a desired level of thermal conductivity. On the other hand, an excess of tabular alumina in the composition tends to cause degradation of the thermomechanical strength of the composition as well as to adversely affect the release properties of the composition. It has been found that between about 128 to 250 parts by weight of tabular alumina per 100 parts by weight of the disilanol polymer produce a composition which has high thermal conductivity, high mechanical strength, good fatigue life and good release properties. Within this range, it is preferred to use about 189–233 parts by weight of tabular alumina per 100 parts of the disilanol polymer.

Another important aspect of the present invention resides in finely divided iron oxide. It is preferred to use iron oxide which has a particle size in the range of submicron up to about 1 micrometer in its number average particle size. In particular, iron oxide is commercially available in a 0.4 micrometer size, and we have found this to be satisfactory. The amount of the iron oxide employed is an important factor. It is believed that the iron oxide serves the function of a reinforcing agent in the composition. Between about 1 to 60 parts by weight iron oxide per 100 parts by weight of the disilanol polymer are suitable. Using insufficient amounts of iron oxide will result in a composition which is relatively low in mechanical strength and has poor swell characteristics under mechanical stress and in the presence of typical release agents. Excessive amounts of iron oxide in the composition yields a material which becomes relatively hard and thus requires more mechanical energy to obtain the desired nip size on a fuser roll, which also leads to shorter fatigue life for the fuser roll. Within this range, we particularly prefer to use about 13 to 28 parts by weight iron oxide per 100 parts by weight of the disilanol polymer.

The crosslinking agent used in the composition for coating the fuser member of the present invention is for the purpose of obtaining a material with sufficient crosslink density to attain maximum strength and fatigue resistance. Examples of crosslinking agents which are suitable for the purposes of the present invention include: esters of orthosilicic acid; esters of polysilicic acid; and akytrialkyoxy silanes. Specific examples of suitable crosslinking agents include: tetramethylorthosilicate; tetraethylorthosilicate; 2-methoxyethylsilicate; tetrahydrofurfurylsilicate; ethylpolysilicate; butylpolysilicate; etc. Alkoxysilanes simultaneously containing hydrogen bound to the silicon atom, such as methyldiethoxysilane or triethoxysilane, are very suitable as are polyalkylhydrosilane. Other suitable crosslinking agents are known to the art. It is preferred to use condensed tatraethylorthosilicate as the crosslinking agent in the composition of the invention. The amount of the crosslinking agent employed is not critical, as long as sufficient amount is used to completely crosslink the active end groups on the disilanol polymers used. In this respect, the amount of crosslinking agent required depends on the number average molecular weight of the disilanol polymer employed. With the higher average molecular weight polymer, there are fewer active end groups present and thus a lesser amount of the crosslinking agent is required, and vice versa. When excess amounts of a crosslinking agent are used, the excess is eadily removed from the cured composition. Generally, for the preferred disilanol polymer of a number average molecular weight of between about 5,000 to 20,000, we have found that between about 6 to 9 parts by weight of condensed tetraethylorthosilicate per 100 parts by weight of the disilanol polymer to be suitable. Within this range, it is preferred to use about 6.6 to 8 parts by weight condensed tetraethylorthosilicate per 100 parts by weight of the disilanol polymer. Of course, if other crosslinking agents are used, the amount to be used should be adjusted stoichiometrically to provide a sufficient amount of the crosslinking agent for the reactive end groups in the disilanol polymer.

Finally, with respect to the crosslinking catalyst used in the composition of the present invention, such catalysts are well known in the art and they include: the amines and carboxylic salts of many metals, such as lead, zinc, zirconium, antimony, iron, cadmium, tin, barium, calcium, and manganese; particularly the naphthenates, octoates, hexoates, laurates and acetates. Examples of suitable catalysts include: stannous octoate; dibutyltin dilaurate; dibutyltin diacetate; and dibutyltin dicaproate. Bis(dibutylchlorotin) oxide and similar compounds can be also used. Other suitable catalysts are disclosed in U.S. Pat. No. 3,664,997. The amount of the catalyst employed is not critical. However, too small an amount of catalyst used leads to a very slow reaction which is impractical. On the other hand, excessive amounts of catalyst may cause a breakdown of the crosslinked polymer network at high temperatures, to yield a less crosslinked and weaker marterial, thus adversely affecting the thermomechanical strength of the cured material. In general, we have found that between about 0.25 to 1.8 parts by weight of catalyst per 100 parts of the disilanol polymer to be preferred. More particularly, we prefer to use between 0.25 to 0.75 parts by weight of catalyst per 100 parts of the polymer. The specific catalysts preferred are dibutyltin dilaurate and bis(dibutylchlorotin) oxide.

The invention will now be described with reference to the following specific examples. Unless otherwise specified, all parts and percentages are by weight.

EXAMPLE I–IV

These examples illustrate the release performance and operational latitude of three release fluids according to the present invention and compare them to the high viscosity materials of the prior art. In each example a fuser roll made as follows was used.

180 grams of Rhodorsil 48V750 disilanol, obtained from the Rhone-Poulenc Company and believed to contain an $\alpha\omega$-hydroxypolydimethyl siloxane having an average viscosity of about 750 Cstk, was mixed with 420 grams of Rhodorsil 48V3500 disilanol, which is believed to be an $\alpha\omega$-hydroxypolydimethyl siloxane having an average viscosity of about 3500 Cstk. The mixture is believed to be a disilanol having a number average molecular weight of about 15,500. The mixture was mixed in a Baker-Perkins Model AN2 mixer which was equipped with thermostatically controlled electrical heaters. To this mixture was added 1284 grams of Alcoa T61 tabular alumina, 325 mesh, over a period of about 10 minutes. Then 150.6 grams of a Mapico Red 297 iron oxide, having an ultimate particle size of about 0.4 micrometer, was added to the mixture over a period of 10 minutes and the mixture was blended for about 2½ hours at room temperature. To this mixture was added 45 grams of a Sibond condensed ethyl silicate, from the Stauffer Chemical Company, and mixing was continued for 1 hour. To this mixture was then added 3 grams of dibutyltin dilaurate catalyst and the mixture was then made into rubber pads for mechanical testing, and it was also coated onto aluminum rolls at a thickness between 60 to 70 mils. After the composition was made into those shaped articles, it was brought to a temperature of 158° F. and cured for a period of 3 hours.

The pads were found to have a pad durometer (Shore A) of 71; a modulus of elasticity, M10(PSI), of 715; a tensile strength (PSI) of 620; and an ultimate elongation of 80 percent.

The coated fuser rolls were placed in a test apparatus simulating a xerographic copying machine fusing system. The coated fuser rolls were operated at a circumferential roll speed of about 15 inches per second, with a biasing force between the fuser roll and a pressure roll of about 30 pounds per linear inch along the length of the fuser roll. The surface of the coated fuser roll was maintained at a temperature of about 385° F.

For each of the Examples a new fuser roll was used to measure the release performance attributable to each of the fuser release fluids mentioned. Each new roll was run 30K copies before release latitude was measured to avoid the new roll transient effect. The scatter of the data was due primarily to the difficulty in determining precisely the instantaneous oil usage rate at the moment the release latitude was measured.

EXAMPLE I

This Example illustrates the latitude obtained with the prior art release fluid, a 60K centistokes blended polydimethyl siloxane available from Dow Corning Company. The results are shown graphically in FIG. 2.

EXAMPLE II

Figure 2:
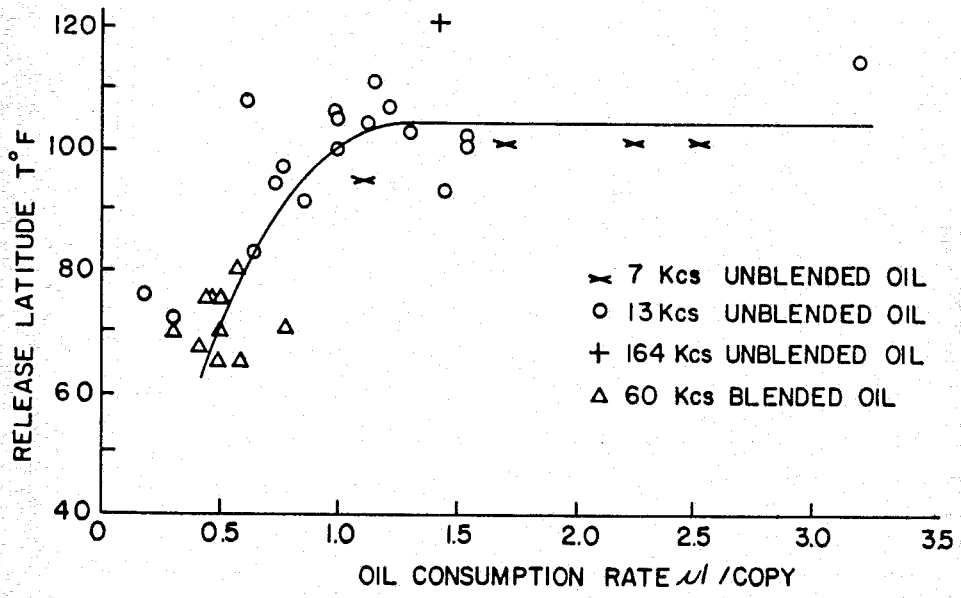
FIG. 2 is a graphical illustration of fusing release latitude for four different fuser release fluids.

This Example illustrates the latitude obtained with an unblended polydimethyl siloxane release fluid available from Dow Corning Company having a kinematic viscosity of about 7K cs, the results of which are graphically illustrated in FIG. 2.

EXAMPLE III

This Example illustrates the latitude obtained with an unblended polydimethyl siloxane release fluid available from Dow Corning Company having a kinematic viscosity of about 13K centistokes, the results of which are graphically illustrated in FIG. 2.

EXAMPLE IV

This Example illustrates the latitude obtained with an unblended polydimethyl siloxane release fluid available from Dow Corning Company having a kinematic viscosity of 16.4K centistokes, the results of which are graphically illustrated in FIG. 2.

The results of Examples I–IV indicate that there is no change in the minimum fix temperature for any of the release fluids tried. However, 60K centistokes blended fluid has a release latitude of only about 70° F., whereas the 7, 13 and 16.4K centistokes fluids according to the present invention have release latitudes considerably in excess of 70° F., and generally in excess of about 90° F. In this connection it should be noted that the 60K centistokes oil is not illustrated at consumption rates in excess of about 0.5 μl/c since this is the normal usage rate for this oil it being very difficult to dispense this oil at a higher rate. As may be observed, there is very little difference between the 7K centistokes, 13K cs and 16.4K cs unblended oils. However, at viscosities below 7K centistokes, the opportunity for toner penetration through the oil layer increases and of course the possibility of the oil swelling the silicone rubber to the point that delamination occurs upon cycling the roll under pressure. In addition, to maintain a release latitude of at least about 90° F., the oil consumption rate should not fall below about 0.8 μl/c.

EXAMPLE V

The procedure of Example I is repeated except that the release fluid is an unblended polydimethyl siloxane having a kinematic viscosity of 53K cs. The release latitude of this oil was only about 50° F. at an oil dispensed rate of 1.25 μl/c which is unsatisfactory.

EXAMPLE VI

The procedure of Example I is repeated except that the release fluid is a blended polydimethyl siloxane having a kinematic viscosity of about 12.5K cs. The blend is a 1 to 1 mixture of 1K cs and 70K cs oils. While the operational latitude of this oil is satisfactory at 112° F. at an oil dispense rate of 0.77 μl/c the number average molecular weight is very low and it swells the silicone rubber excessively and is therefore unsatisfactory.

EXAMPLES VII-XI

These Examples illustrate the effect of four polydimethyl siloxane oils according to the present invention on soft failure compared against the prior art 60K cs blended polydimethyl siloxane oil. Soft failure results from the step created on the fuser roll along the edge of the paper path due to both the compaction inside the paper path and swelling outside the paper path. When wider paper is subsequently used, the toner will not be properly fused along this step when the step height exceeds about 3.0 mils. A new fuser roll as described in Example I is used with each of the fuser release agents. Each roll is run in cycles making 100 copies followed by four minutes rest. Only plain paper was run through the fuser since the toner image was not a necessary part of this study. The results are shown in the table below.

TABLE 1

Step in mils height at the 11" paper path edge created on the fuser with various oils.

| | Oil | | | | |
|---|---|---|---|---|---|
| Copies | 1K cs | 7K cs | 10K cs | 13K cs | 60K cs blend |
| 10K | 1.7 | 0.8 | 0.5 | 0.8 | 0.9 |
| 20K | | 1.1 | 0.9 | 1.3 | 1.2 |
| 25K | | 1.2 | | | |
| 30K | | | 1.0 | 1.7 | 1.8 |
| 35K | | 1.3 | | 1.4 | 1.8 |
| 40K | | | 1.2 | | |
| 45K | | | 1.5 | 1.3 | 1.6 |
| 50K | | | 1.6 | | |
| 100K | | 1.8 | | 1.4 | 1.9 |
| 150K | | | | 1.4 | 2.0 |

The step created with the 1K centistokes unblended oil was excessive and therefore this test was terminated after 10K copies. In each instance, the steps created by the fuser release agents were substantially equal to or smaller than those achieved with 60K cs blended release agent. This is particularly true at the high copy rates of 100K and 150K.

In accordance with the present invention an improved toner image fusing system is provided. In particular, a toner release fluid comprising a silicone oil interacts with a silicone rubber fuser surface to provide the heretofore desirable properties achieved only with either high or low viscosity release fluids. Specifically, the toner release agent of the present invention exhibits the silicone rubber swelling properties of a high viscosity material while at the same time exhibiting the wicking and toner handling properties of a low viscosity release fluid. In addition, a surprising additional advantage is achieved in that a fuser system employs such a silicone oil toner release fluid has superior operational latitude between minimum fix temperature and the toner hot offset temperature. Within the range of 7K cs to 20K cs the release latitude is not very sensitive to the viscosity of the unblended polydimethyl siloxanes. Further we have shown that we obtain good latitude by increasing the quantity used of a lower viscosity oi. In this regard we note that the amount of oil necessary is independent of viscosity and that the same degree of hot offset temperature can be changed by changing the amount of oil used. For our system we have found that the oil consumption rate should be of the order of at least about 0.8 μl/copy to achieve a release latitude of at least about 90° F. In addition with the ability to use a lower viscosity oil, the amount of oil on the first copy is reduced which is desired.

As may be observed with reference to the foregoing specification including the drawings, and as distinguished from the Prior Art materials described on pages 4 and 5 of the specification, the polydimethyl siloxane fluid of the present invention is applied directly to the silicone elastomer fusing surface in a non-emulsified form.

Unless otherwise specified all parts and percentages expressed herein are by weight.

While the invention has been described in detail with reference to specific and preferred embodiments, it will be appreciated that various modifications may be made from the specific details without departing from the spirit and scope of the invention. It is intended that any such modification as may be made by one skilled in the art shall come within the scope of the appended claims.

We claim:

1. The method of fusing toner images to a substrate comprising providing a fusing member having a silicone elastomer fusing surface, heating said fuser member to an elevated temperature to fuse said toner to said substrate, applying directly to said silicone elastomer fusing surface in non-emulsified form an unblended polydimethyl siloxane having a kinematic viscosity of from about 7,000 centistokes to about 20,000 centistokes, and contacting the toner image on said substrate with said heated fusing member to thereby fuse said toner image to said substrate.

2. The method of fusing according to claim 1 wherein said unblended polydimethyl siloxane has a kinematic viscosity of from about 10,000 centistokes to about 16,000 centistokes.

3. The method of fusing according to claim 1 wherein said polydimethyl siloxane has a kinematic viscosity of about 13,000 centistokes.

4. The method of fusing according to claim 1 wherein the difference between the minimum temperature at which toner will be fixed to the substrate and the temperature at which hot toner will offset to the fuser roll is at least about 90° F.

5. The method of fusing according to claim 1 wherein said unblended polydimethyl siloxane oil has been devolatilized.

6. The method of fusing according to claim 1 wherein said polydimethyl siloxane provides a swell of said silicone elastomer of less than about 4% by volume.

7. The method of fusing according to claim 1 wherein the consumption rate of the polydimethyl siloxane oil is at least about 0.8 μl/c.

8. The method of fusing according to claim 1 wherein said unblended polydimethyl siloxane has a ratio of weight average molecular weight to number average molecular weight of less than about 2.5.

9. The method of fusing according to claim 1 wherein said fusing member is thermally conductive and comprises a rigid substate coated with a thin layer of a silicone elastomer.

10. The method of fusing according to claim 9 wherein said silicone elastomer is the crosslinked product of a mixture of about 100 parts by weight of αω-dihydroxypolydimethylsiloxane, about 128 to 250 parts by weight of finely divided tabular alumina, and 13 to 60 parts by weight of finely divided iron oxide particles, and a crosslinking agent and crosslinking catalyst in an amount sufficient to form the crosslinked product and said silicone elastomer is present as a thin layer on a base.

11. The method of fusing according to claim 10 wherein said base is a metallic roll, and wherein said thin layer is about 10 to 100 mills thick.

12. A method of fusing according to claim 11 wherein said metallic roll is made of aluminum, and wherein said thin layer is about 30 to 80 mils thick.

13. A method of fusing according to claim 12 wherein said thin layer is about 60 to 70 mils thick.

14. A method of fusing according to claim 12 wherein said αω-dihydroxypolydimethylsiloxane has a number average molecular weight between about 5,000 to 20,000 wherein said crosslinking agent is about 6 to 9 parts by weight of condensed tetraethylorthosilicate, and wherein said crosslinking catalyst is about 0.25 to 1.8 parts by weight of dibutyltin dilaurate or bis(dibutylchlorotin) oxide.

15. A method of fusing according to claim 14 wherein said tabular alumina is about 325 mesh in size, and wherein said iron oxide particles have a number average particle size of about less than 1 micrometer.

16. A method of fusing according to claim 15 wherein said tabular alumina is present in an amount about 189–233 parts by weight, wherein said iron oxide present in an amount about 13–28 parts by weight, wherein said condensed tetraethylorthosilicate is present in an amount about 6.6 to 8 parts by weight, and wherein said catalyst is present in an amount about 0.25 to 0.75 parts by weight.

17. A method of fusing according to claim 16 wherein said thin layer is about 60–70 mils thick.

18. A method of fusing according to claim 15 wherein said tabular alumina is present in an amount about 189 parts by weight, wherein said iron oxide is present in an amount about 28 parts by weight, wherein said condensed tetraethylorthosilicate is present in an amount about 7.5 parts by weight, and wherein said catalyst is present in an amount about 0.5 parts by weight.

19. A method of fusing according to claim 18 wherein said thin layer is about 60–70 mils thick.

* * * * *